US008782937B2

(12) United States Patent
Grossman et al.

(10) Patent No.: US 8,782,937 B2
(45) Date of Patent: Jul. 22, 2014

(54) SAFETY INDEX FOR A FIREARM

(75) Inventors: David A. Grossman, Mascoutah, IL (US); Jonathon D. Grossman, Mascoutah, IL (US); Bruce K. Siddle, Mascoutah, IL (US)

(73) Assignees: David A. Grossman, Mascoutah, IL (US); Jonathan D. Grossman, Mascoutah, IL (US); Bruce K. Siddle, Millstadt, IL (US)

( * ) Notice: Subject to any disclaimer, the term of this patent is extended or adjusted under 35 U.S.C. 154(b) by 0 days.

(21) Appl. No.: 13/588,690

(22) Filed: Aug. 17, 2012

(65) Prior Publication Data

US 2014/0047748 A1 Feb. 20, 2014

(51) Int. Cl.
*F41C 27/00* (2006.01)

(52) U.S. Cl.
USPC ..... 42/1.01; 42/70.01; 42/85; 42/90

(58) Field of Classification Search
USPC ..... 42/1.01, 70.01, 71.01, 71.02, 85, 104, 42/106; 434/16
See application file for complete search history.

(56) References Cited

U.S. PATENT DOCUMENTS

| | | | | |
|---|---|---|---|---|
| 189,721 | A | | 4/1877 | Freund |
| 607,344 | A | | 7/1898 | Cooper |
| 694,969 | A | * | 3/1902 | Kemp ..... 42/59 |
| 837,563 | A | | 12/1906 | Hartman |
| 1,087,747 | A | | 2/1914 | Evans |
| 1,277,002 | A | | 8/1918 | Van Name |
| 1,363,553 | A | | 12/1920 | Barringer |
| 1,475,037 | A | | 11/1923 | Thimgren |
| 1,680,186 | A | | 8/1928 | Von Frommer |
| 1,890,005 | A | | 12/1932 | Stiennon |
| 2,058,305 | A | | 10/1936 | Forsling |
| 2,270,707 | A | * | 1/1942 | Humski ..... 42/111 |
| D142,016 | S | | 8/1945 | Birk |
| D177,679 | S | | 5/1956 | Ivy |
| 3,065,560 | A | | 11/1962 | Bumiller |
| 3,090,123 | A | | 5/1963 | Barnes |
| 3,381,380 | A | | 5/1968 | Thomas |
| D218,931 | S | | 10/1970 | Quinn |
| 3,641,676 | A | | 2/1972 | Knutsen et al. |
| 3,698,091 | A | | 10/1972 | Merrill et al. |
| 4,476,644 | A | | 10/1984 | Laing |
| 4,601,123 | A | | 7/1986 | Swearengen et al. |
| 5,065,519 | A | | 11/1991 | Bindon |
| 5,359,800 | A | | 11/1994 | Fisher et al. |
| 5,426,882 | A | | 6/1995 | Dornaus |
| 5,515,636 | A | | 5/1996 | McGarry et al. |
| 5,560,133 | A | | 10/1996 | Kuebler |

(Continued)

OTHER PUBLICATIONS

KSC M17, Sep. 19, 2011, www.north-texas-airsoft.org/wiki/index.php?title=KSC_M17&oldid=1511.

(Continued)

*Primary Examiner* — Bret Hayes
*Assistant Examiner* — Derrick Morgan
(74) *Attorney, Agent, or Firm* — Thompson Coburn LLP

(57) ABSTRACT

A firearm has a safety index that may be an elongate depression or an elongate convexity formed on a frame of the firearm adjacent a trigger of the firearm, and may further include a plurality of raised dots. The safety index is configured to allow a user of the firearm to move between the safety index and the trigger, as necessary, for instance, as the user goes between non-firing and firing conditions.

7 Claims, 5 Drawing Sheets

(56) References Cited

U.S. PATENT DOCUMENTS

| | | | | |
|---|---|---|---|---|
| 5,654,594 | A * | 8/1997 | Bjornsen et al. | 307/115 |
| D416,069 | S | 11/1999 | Emerson | |
| D435,281 | S | 12/2000 | Ling, Jr. | |
| 6,216,351 | B1 | 4/2001 | Flubacher et al. | |
| D447,206 | S | 8/2001 | Ling, Jr. | |
| 6,360,471 | B1 | 3/2002 | Stein | |
| 6,363,647 | B2 * | 4/2002 | Kaminski | 42/70.11 |
| 6,388,655 | B1 | 5/2002 | Leung | |
| 6,481,137 | B2 | 11/2002 | Kornberger | |
| 6,622,412 | B1 | 9/2003 | Wilkes | |
| 6,769,210 | B2 | 8/2004 | Bubits | |
| 6,775,940 | B2 | 8/2004 | Dworzan et al. | |
| 6,860,053 | B2 * | 3/2005 | Christiansen | 42/71.02 |
| D562,931 | S | 2/2008 | Szabo | |
| D564,291 | S | 3/2008 | Zemel | |
| D565,144 | S | 3/2008 | Price | |
| 7,509,766 | B2 | 3/2009 | Vasquez | |
| D604,794 | S | 11/2009 | Bentley | |
| 7,786,397 | B2 | 8/2010 | Dick | |
| 7,832,138 | B1 | 11/2010 | Price | |
| 8,132,352 | B2 | 3/2012 | Lippard | |
| D658,263 | S | 4/2012 | Nierenberg | |
| D658,738 | S | 5/2012 | Lund | |
| 8,181,378 | B2 * | 5/2012 | Losinger | 42/85 |
| 8,191,301 | B2 | 6/2012 | Hatfield | |
| 8,261,481 | B1 | 9/2012 | Shebaro | |
| 8,479,433 | B1 | 7/2013 | Shebaro | |
| 8,497,767 | B2 | 7/2013 | Hollis, Jr. | |
| RE44,786 | E * | 3/2014 | Hudson et al. | 340/686.1 |
| 2002/0170224 | A1 * | 11/2002 | Lawless | 42/71.02 |
| 2002/0194767 | A1 * | 12/2002 | Houde-Walter et al. | 42/114 |
| 2004/0216348 | A1 * | 11/2004 | McMoore | 42/70.07 |
| 2005/0229457 | A1 * | 10/2005 | McGarry | 42/1.01 |
| 2006/0156608 | A1 * | 7/2006 | Kellermann et al. | 42/71.02 |
| 2009/0071056 | A1 | 3/2009 | Storch et al. | |
| 2010/0170138 | A1 | 7/2010 | Zukowski | |
| 2010/0225064 | A1 * | 9/2010 | Deatherage, Jr. | 273/405 |
| 2010/0263254 | A1 | 10/2010 | Glock | |
| 2010/0319234 | A1 | 12/2010 | Clouser | |
| 2011/0047847 | A1 | 3/2011 | Hughes et al. | |
| 2011/0107642 | A1 | 5/2011 | Godard | |
| 2011/0138667 | A1 | 6/2011 | Bolden | |
| 2011/0314721 | A1 | 12/2011 | Lamb | |
| 2012/0005930 | A1 | 1/2012 | Cragg | |
| 2012/0141957 | A1 * | 6/2012 | Miller | 434/16 |
| 2012/0144721 | A1 | 6/2012 | Glimpse et al. | |
| 2012/0198744 | A1 | 8/2012 | Meller et al. | |
| 2013/0000173 | A1 | 1/2013 | Green et al. | |
| 2013/0081318 | A1 | 4/2013 | Morando | |
| 2013/0185983 | A1 | 7/2013 | Glimpse et al. | |

OTHER PUBLICATIONS

X-Treme Grips, Dec. 8, 2009, https://www.facebook.com/pages/X-Treme-Grips/197937916894?id=197937916894&sk=photos_stream.

Smith&WessonForums.com, Dec. 23, 2011, pp. 1-5.

* cited by examiner

SAFETY INDEX FOR A FIREARM

BACKGROUND

The following disclosure relates to an aid to assist a user in using a firearm. Specifically, the disclosure relates to a safety index that assist the user in locating the user's trigger finger between non-firing and firing conditions.

DETAILED DESCRIPTION

Figure 1:
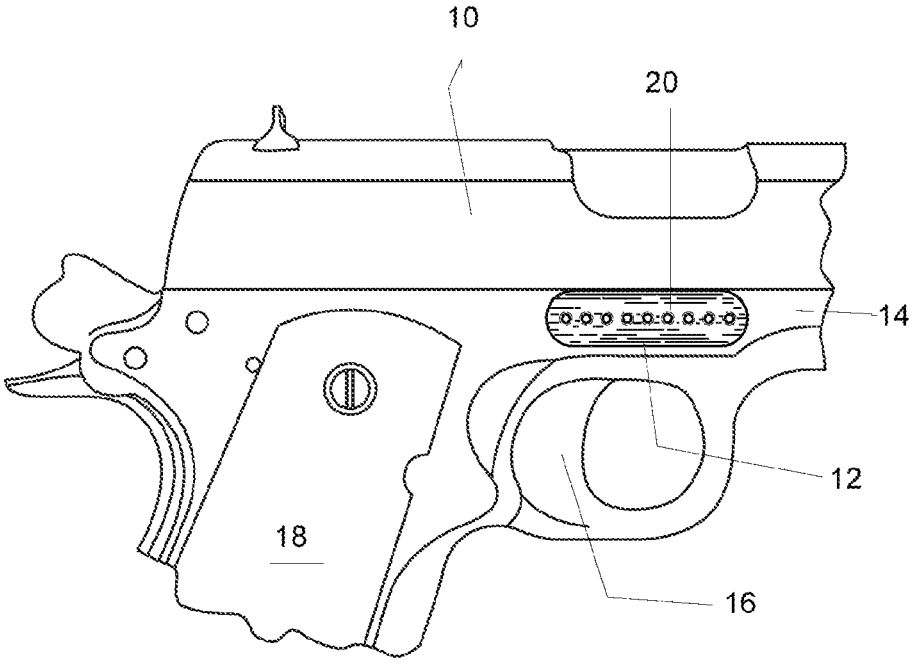
FIG. 1 is an exemplary fire arm comprising a Model 1911 hand gun with a safety index comprising an elongate depression located on a right side of the hand gun.
Figure 2:
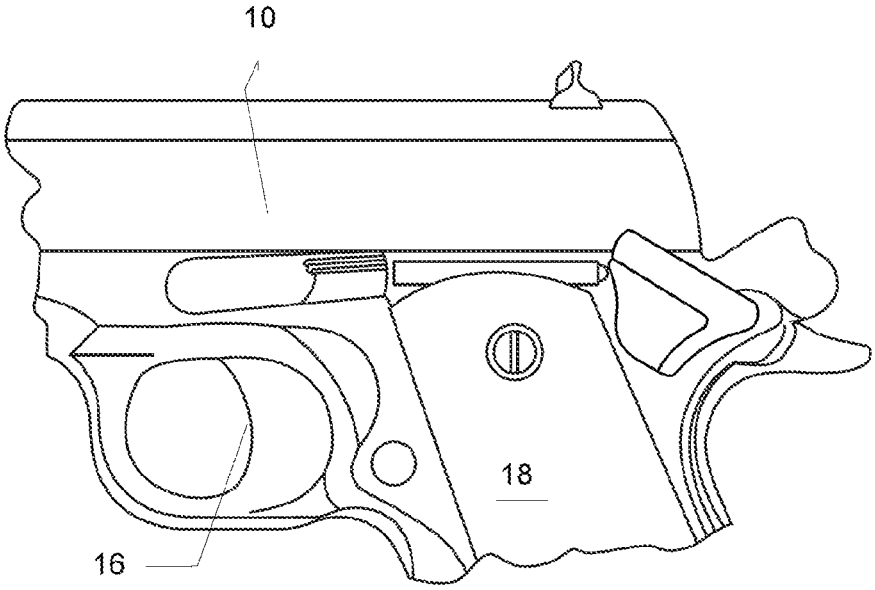
FIG. 2 is a left side view of the firearm of FIG. 1.
Figure 3:
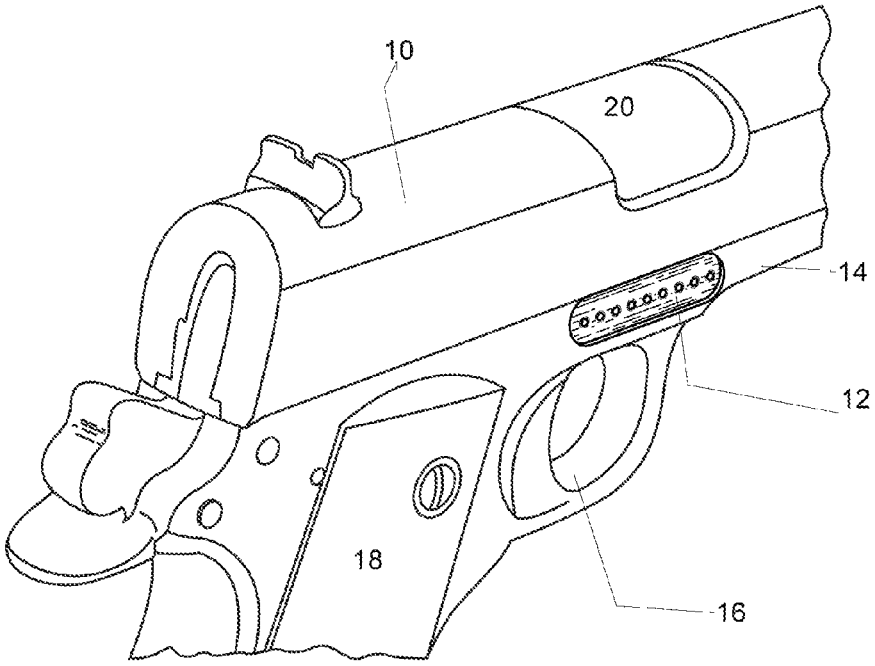
FIG. 3 is a perspective view of the firearm of FIG. 1.
Figure 4:
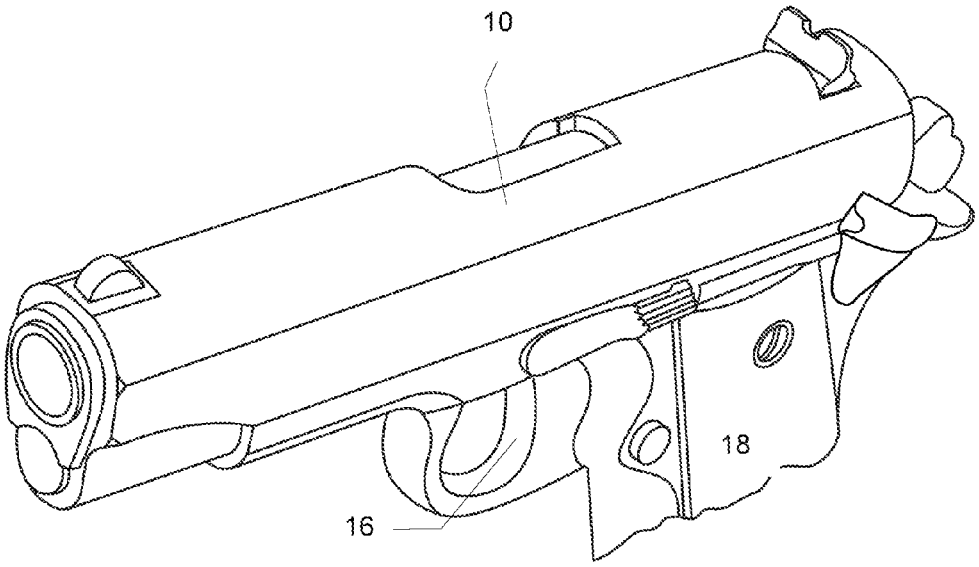
FIG. 4 is a perspective view of the firearm of FIG. 1.
Figure 5:
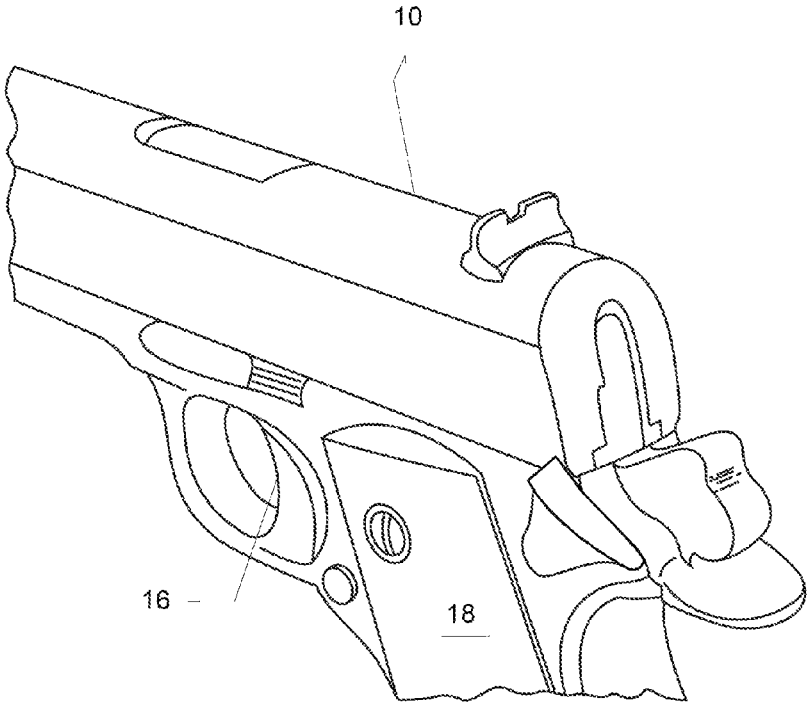
FIG. 5 is a perspective view of the firearm of FIG. 1.
Figure 6:
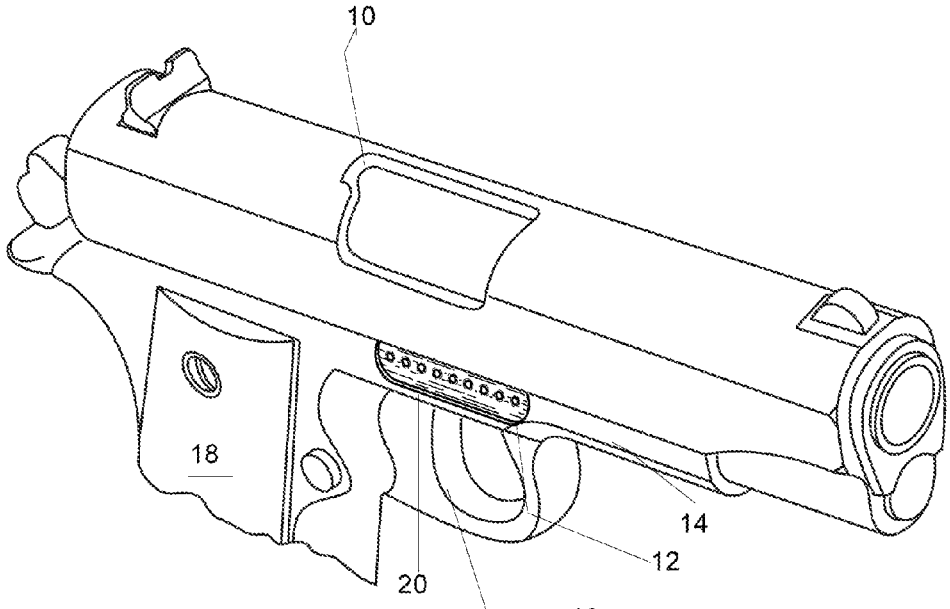
FIG. 6 is a perspective view of the firearm of FIG. 1.

With reference to the drawings, a firearm 10 comprising a Model 1911 hand gun has a safety index 12 applied to a frame 14 of the firearm to assist the user in locating the user's trigger finger in a non-firing and firing condition. In a non-firing condition, the user may place the user's finger on the safety index 12 rather than a trigger 16 of the firearm. Thus, the user may use the safety index 12 as a reference point rather than another location in a non-firing condition. This may prove useful in many scenarios. For instance, during training, a user may be instructed to place the user's finger on the safety index to provide a visual indication to the trainer that the user is in a non-firing condition. Providing the safety index in standard location on a firearm also facilitates this end by providing a quick visual aid to trainers to see that a user/trainee has complied with instructions to go to a non-firing condition. Also, a safety index provides a user with an aid to safely operate a firearm in a stressful condition. Because the safety index is located in close proximity to the trigger, the user may disengage the safety index and engage the trigger quickly to discharge the firearm. However, the safety index requires intentional movement by the user to disengage the safety index and engage the trigger, as opposed to other locations where such movement of the user's trigger finger may be less intentional.

The safety index 12 is located in a position on the frame 14 of the firearm that allows the user to manipulate the user's trigger finger on the safety index while the user's trigger finger hand grasps a grip 18 of the firearm. Thus, the user may continue to grasp the grip 18 of the firearm without significant movement of the user's hand as the user's senses the safety index 12 with the user's trigger finger. However, the safety index 12 is in a position on the frame 14 of the firearm that allows the user to easily move between the safety index and the trigger 16, as necessary, for instance, as the user goes between non-firing and firing conditions.

In one embodiment, the safety index 12 comprises an elongate depression which may be formed in the frame of the hand gun. The user may place the user's fingertip in the depression.

Figure 7:
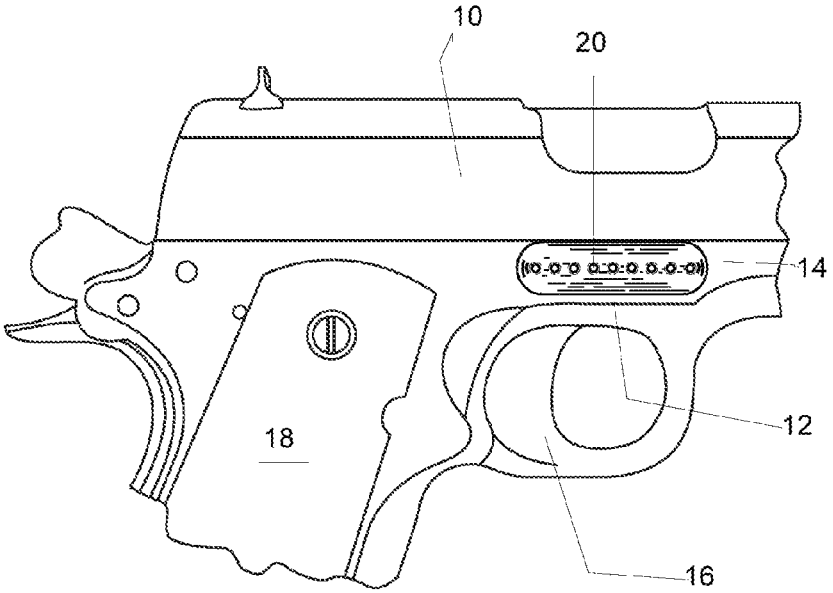
FIG. 7 is alternate embodiment of the safety index of FIGS. 1-6 comprising an elongate convexity applied to an exemplary fire arm comprising a Model 1911 hand gun with the safety index located on a right side of the hand gun.
Figure 8:
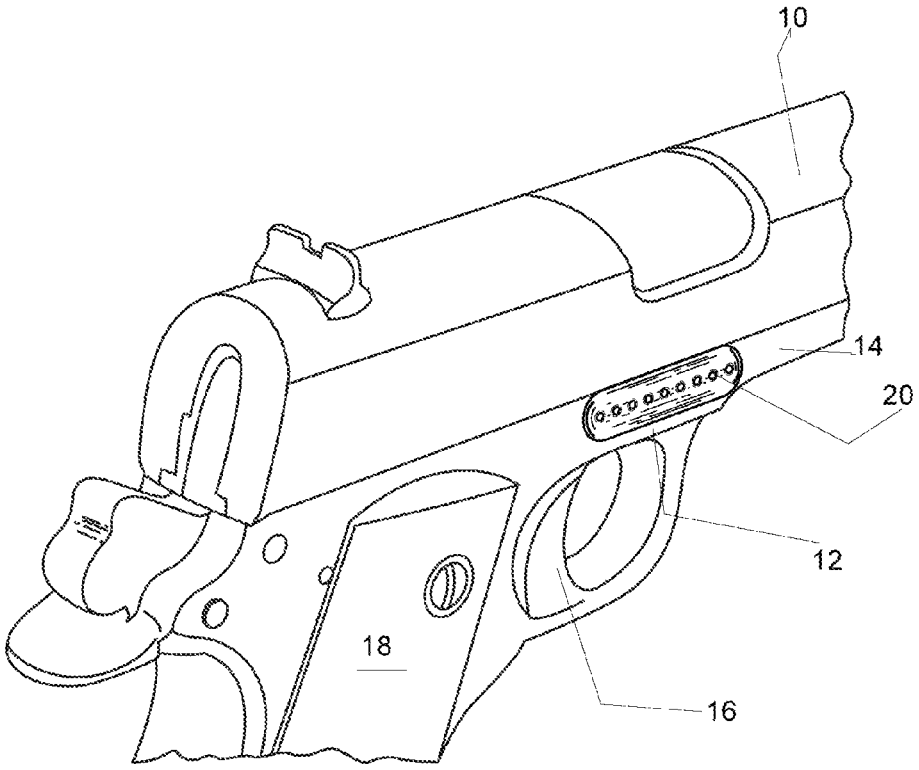
FIG. 8 is a perspective view of the firearm of FIG. 7.

Because the frame 14 of the handgun adjacent the trigger is generally flat, the elongate depression provides a tactile indication for the user to locate the safety index. The elongate depression safety index may further comprise a plurality of raised dots 20 in the center of the elongate depression to provide the user with an additional tactile indication to locate the safety index on the side of the frame of the handgun. In an alternate embodiment (FIGS. 7,8), the safety index may comprise an elongate convexity, and may further include raised dots in the center of the elongate convexity to assist the user in finding the elongate convexity on the side of the frame of the firearm. While the safety index is shown as an elongate depression or an elongate convexity, other shapes may be used. While the drawings show nine raised dots in the elongate depression, more or less raised dots may be used. FIG. 1 shows the safety index 12 as may be used on a Model 1911 handgun. The safety index may be provided on both sides of a single firearm or the left or right side depending upon the dominant hand of the user and the style of firearm. While the drawings show a handgun, the safety index may be applied to any weapon system/firearm with a trigger. The drawings are not intended to be limiting in any sense.

Figure 9:
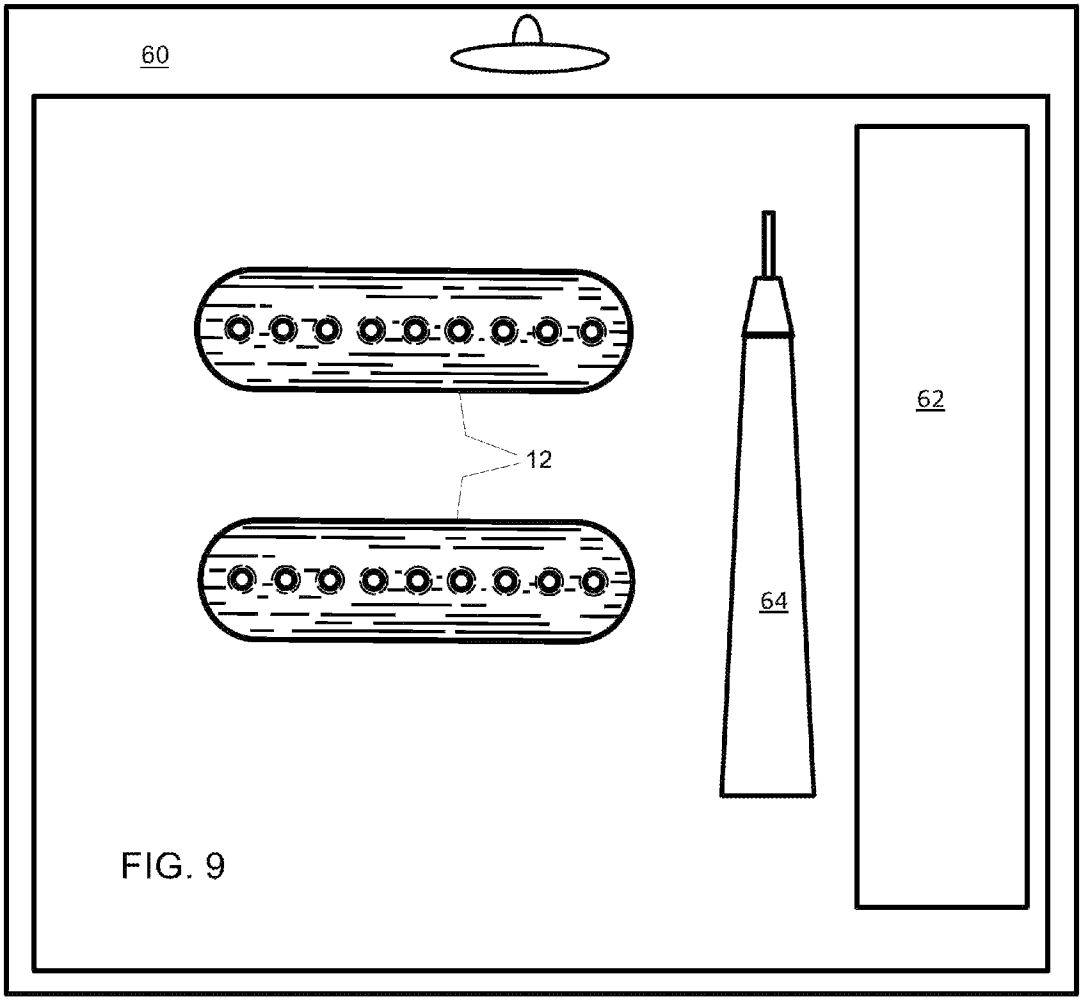
FIG. 9 is a plan view of a kit comprising a safety index that may be applied to a firearm.

As shown in FIG. 9, the safety index 12 may be provided as a kit 60. For instance, the safety index in the form of a convexity may be provided as a kit to retrofit an existing firearm. The kit may contain instructions or other indicia 62, and other items 64 for applying the convexity of the kit to the firearm. The convexity of the kit may be mechanically attached, welded, soldered, brazed, or otherwise adhered to the firearm. The kit shows a representative configuration of the safety index. Other shapes and configurations may be used.

The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method comprising:

providing a firearm wherein the firearm has a frame and a trigger extending from the frame;

providing a safety index having a plurality raised of circular dots extending in a straight line along a length of the safety index;

arranging the safety index on a lateral side of the frame of the firearm to allow a user of the fire arm to move the user's trigger finger between the safety index and the trigger without significant movement of the user's hand, and to allow the user of the firearm to sense the raised dots portion of the safety index with the user's trigger finger and to establish an off-trigger location for the user's trigger finger; and directing a user of the firearm to move the user's trigger finger between the safety index and the trigger;

wherein the step arranging the safety index on a lateral side of the firearm includes adhering the safety index to the lateral side of the firearm.

2. The method of claim 1, wherein the safety index comprises an elongate convexity.

3. The method of claim 2, wherein the convexity comprises a kit associated with the firearm.

4. The method of claim 1 wherein the step of directing the user includes providing instructions in the kit.

5. The method of claim 1 wherein the step of directing the user includes instructing the user to place the user's trigger finger on the safety index to indicate a non-firing condition.

6. The method of claim 1, wherein the step of arranging the safety index on a lateral side of the frame of the firearm includes arranging the safety index on a right lateral side of the firearm.

7. The method of claim 1 wherein the step of directing the user includes instructing the user to place the user's trigger finger on the safety index to safely operate the firearm.

* * * * *